US008127829B2

(12) United States Patent
Sabatino et al.

(10) Patent No.: US 8,127,829 B2
(45) Date of Patent: Mar. 6, 2012

(54) METAL FOAM HEAT EXCHANGER

(75) Inventors: Daniel R. Sabatino, East Hampton, CT (US); Scott F. Kaslusky, West Hartford, CT (US); Hayden M. Reeve, West Hartford, CT (US); Louis J. Spadaccini, Manchester, CT (US); Louis Chiappetta, South Windsor, CT (US); He Huang, Glastonbury, CT (US); David R. Sobel, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 1431 days.

(21) Appl. No.: 11/516,402

(22) Filed: Sep. 6, 2006

(65) Prior Publication Data

US 2010/0218921 A1 Sep. 2, 2010

(51) Int. Cl.
*F28F 7/00* (2006.01)
*F02C 6/00* (2006.01)

(52) U.S. Cl. ..... 165/80.3; 165/146; 165/181

(58) Field of Classification Search ..... 165/80.3, 165/80.4, 104.33, 907, 915, 133, 146, 51, 165/52, 164, 181; 60/39.183, 39.83; *F02C 6/00; F28F 7/00*

See application file for complete search history.

(56) References Cited

U.S. PATENT DOCUMENTS

| | | | | |
|---|---|---|---|---|
| 4,245,469 | A * | 1/1981 | Fortini et al. | 60/204 |
| 4,538,666 | A * | 9/1985 | Takeshima et al. | 164/305 |
| 5,363,641 | A * | 11/1994 | Dixon et al. | 60/778 |
| 6,050,080 | A * | 4/2000 | Horner | 60/784 |
| 6,142,222 | A * | 11/2000 | Kang et al. | 165/148 |
| 7,086,457 | B2 * | 8/2006 | Kienbock et al. | 165/148 |
| 7,467,467 | B2 * | 12/2008 | Prociw | 29/890.041 |
| 7,537,646 | B2 * | 5/2009 | Chen et al. | 96/6 |
| 2004/0194627 | A1 * | 10/2004 | Huang et al. | 96/6 |
| 2004/0226702 | A1 * | 11/2004 | Toonen et al. | 165/164 |
| 2006/0096750 | A1 * | 5/2006 | Meuzelaar | 165/181 |

FOREIGN PATENT DOCUMENTS

| | | | |
|---|---|---|---|
| DE | 3906446 | A1 * | 9/1990 |
| JP | 02008691 | A * | 1/1990 |
| KR | 1020040047684 | A | 6/2004 |
| KR | 1020040106587 | | 12/2004 |
| WO | WO03/100350 | A1 | 12/2003 |

* cited by examiner

*Primary Examiner* — Tho V Duong

(74) *Attorney, Agent, or Firm* — Carlson, Gaskey & Olds, P.C.

(57) ABSTRACT

A heat exchanger includes one or more passages and one or more metal foam sections adjacent the passage to promote an exchange of heat relative to the passage. The metal foam section includes a nominal thermal conductivity gradient there though to provide a desirable balance of heat exchange properties within the metal foam section.

19 Claims, 4 Drawing Sheets

METAL FOAM HEAT EXCHANGER

This invention was made with support of the Office of Naval Research under Contract No.: N00014-00-2-0002. The government therefore has certain rights in this invention.

BACKGROUND OF THE INVENTION

This invention relates to heat transfer and, more particularly, to heat exchangers. Heat exchangers are widely known and used to transfer heat from one fluid to another fluid for a desired purpose. One conventional heat exchanger is a tube and fin type that generally includes fluid transfer tubes and heat conducting fins between the tubes. A fluid flows through the tubes and another fluid flows over the fins. Heat from the higher temperature one of the fluids is transferred through the tubes and fins to the other, lower temperature fluid to cool the higher temperature fluid and heat the lower temperature fluid.

Although conventional tube and fin heat exchangers are effective in many applications, alternative arrangements are sometimes desired to meet the needs of other applications. Thus, there is a desire for novel heat exchangers, such as a metal foam heat exchanger, and systems utilizing the same. This invention addresses those needs while avoiding the shortcomings and drawbacks of the prior art.

SUMMARY OF THE INVENTION

An example heat exchanger includes one or more passages and one or more metal foam sections adjacent the passage to promote an exchange of heat relative to the passage. The metal foam section includes a nominal thermal conductivity gradient there through to provide a desirable balance of heat exchange properties within the metal foam section.

In another aspect, an example heat exchanger includes a first passage and a second passage arranged in a heat exchange relation relative to the first passage such that the first passage is within the second passage. One or more metal foam sections are disposed within the first passage to promote an exchange of heat between the first passage and the second passage.

In another aspect, an example heat exchanger system for use in an aircraft includes an aircraft device operative to circulate a fluid through one or more heat exchangers having a passage for receiving the heated fluid and a metal foam section adjacent the passage to promote an exchange of heat for cooling of fluid.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

FIG. 1 illustrates an example heat exchanger having a metal foam section with a nominal thermal conductivity gradient there through.

DETAILED DESCRIPTION OF THE PREFERRED EMBODIMENT

Figure 1:
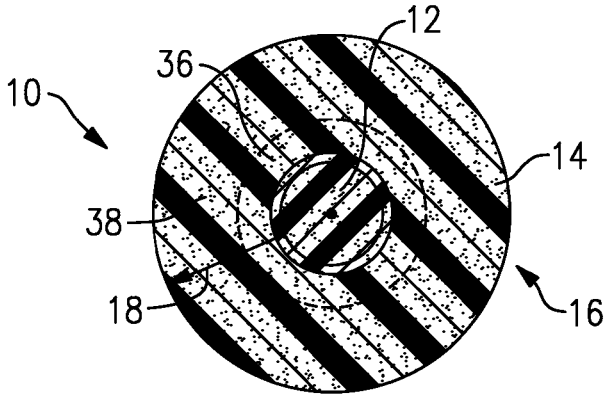
Figure 2:
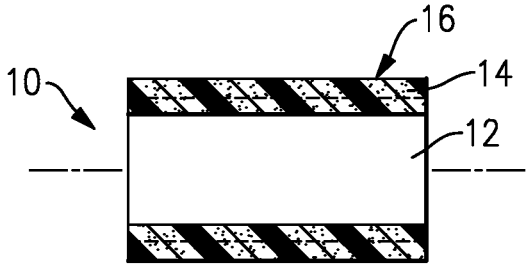
FIG. 2 illustrates a longitudinal cross-section of the heat exchanger shown in FIG. 1.

FIG. 1 schematically illustrates an axial cross-sectional view of an example heat exchanger 10, and FIG. 2 shows a longitudinal cross-sectional view. In this example, the heat exchanger 10 includes a first passage 12 and a second passage 14 adjacent the first passage 12. A first fluid flows within the first passage 12 and a second fluid flows within the second passage 14 such that heat (i.e., thermal energy) from the higher temperature one of the fluids is transferred to the other, lower temperature fluid to cool the higher temperature fluid and heat the lower temperature fluid in a desired manner.

In the illustrated example, the second passage 14 includes a metal foam section 16 that promotes heat exchange between the first fluid and the second fluid. In this example, the metal foam section 16 is within the second passage 14, however, as will be described below, the metal foam section 16 may alternatively be located within the first passage 12. The metal foam section 16 provides the benefit of promoting heat conduction between the first passage 12 and the second passage 14 by providing surface area to conduct the heat through. The metal foam section 16 includes an open cell structure that permits fluid flow there through such that the second fluid flowing through the second passage 14 flows over the surfaces of the metal foam section 16 to exchange heat to or from the metal foam section 16. The meal foam section 16 thereby conducts the heat with the first passage 14. The metal foam section 16 also mixes the second fluid as it flows through the cells of the metal foam section 16. The mixing promotes greater contact between the second fluid and the surfaces of the metal foam section 16, thereby increasing heat exchange between the second fluid and the metal foam section.

In the illustrated example, the metal foam section 16 includes a nominal thermal conductivity gradient 18 there through. The nominal thermal conductivity gradient 18 provides a first nominal thermal conductivity within the metal foam section 16 near the first passage 12 that changes as a function of distance from the first passage 12. Although the nominal thermal conductivity gradient 18 is shown in a certain direction in the examples herein, it is to be understood that the nominal thermal conductivity gradient direction may be altered as desired using the principles described herein. As seen for example in FIG. 3, the nominal thermal conductivity gradient 18 (K) may be tailored to a variety of desired profiles as a function of distance from the first passage 12.

In one example, the line 20 represents a linear relation between the nominal thermal conductivity gradient 18 and distance from the first passage 12. In another example shown by the line 22, the nominal thermal conductivity drops sharply as a function of distance from the first passage 12. In two other examples represented by lines 24 and 26, respectively, the nominal thermal conductivity gradient 18 changes non-linearly as a function of distance from the first passage 12. It is to be understood that the nominal thermal conductivity gradient 18 may have other profiles than what is shown in examples in FIG. 3, depending on the needs of a particular use. The nominal thermal conductivity gradient 18 provides the benefit of being able to tailor the heat exchange and flow-through (i.e., pressure drop) characteristics of the heat exchanger 10 in a desired manner.

Figure 3:
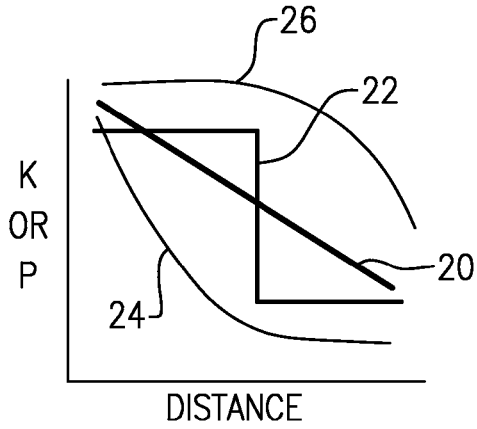
FIG. 3 illustrates schematically example profiles of the nominal thermal conductivity gradient through the metal foam section shown in FIG. 1.

Referring to the example of FIGS. 1 and 2, the metal foam section 16 includes a first, proximal section 36 that is near the first passage 12 and a second, distal section 38 that is located radially outwards from the proximal section 36. The proximal section 36 includes a first effective density and the distal section 38 includes a second effective density that is less than the first pore density. The effective density of the metal foam section 16 is one factor that controls the heat exchange and flow-through properties of the heat exchanger 10. For example, a relatively high effective density provides additional surface area for mixing and contacting the second fluid flowing through the second passage 14 for a greater heat exchange effect. However, the relatively high effective density obstructs flow of the second fluid, which results in a nominal pressure drop. In contrast, a relatively low effective density provides less surface area for mixing and exchanging heat and a corresponding lower heat exchange effect. However, the relatively low effective density provides less obstruction of flow. Thus, selecting effective densities of the proximal section 36 and the distal section 38 for a desired nominal thermal conductivity gradient 18 within the metal foam section 16 allows one to tailor the heat exchange and pressure drop effects within the heat exchanger 10. A nominal effective density gradient (P) corresponds to the nominal thermal conductivity gradient 18 and can have similar profiles as shown in FIG. 3.

In one example, the proximal section 36 has an effective density that is greater than the effective density of the distal section 38. Thus, the proximal section 36 provides a greater local heat exchanging effect, with a local relative pressure drop penalty. The distal section 38 provides relatively better local flow-through, with a relative local penalty in heat exchange properties. The metal foam section 16 thereby provides the benefit of greater heat exchange near the perimeter of the first passage (i.e., where a significant portion of thermal energy transfer occurs) without the overall pressure drop penalty that would occur if the entire metal foam section 16 were made of the greater effective density. In some embodiments however, the pressure drop or thermal energy transfer requirements may not be as much of a concern. Thus, the metal foam section 16 can also have a uniform nominal thermal conductivity (i.e., no nominal thermal conductivity gradient 18) with a nominally uniform effective density throughout.

In another example similar to the above example using effective density, the porosities of the sections 35 and 38 differ. The porosity of the metal foam section 16 is another factor that controls the heat exchange and flow-through properties of the heat exchanger 10. In this example, the proximal section 36 includes a first porosity and the distal section 38 includes a second porosity that is greater than the first porosity. In general, a relatively low porosity provides a greater local heat exchanging effect but obstructs flow of the second fluid, which results in a nominal pressure drop. In contrast, a relatively high porosity provides a lesser local heat exchanging effect but less obstruction of flow. Thus, selecting porosities of the proximal section 36 and the distal section 38 for a desired nominal thermal conductivity gradient 18 within the metal foam section 16 allows one to tailor the heat exchange and pressure drop effects within the heat exchanger 10. Given this description, one of ordinary skill in the art will recognize other metal foam features that can be varied to provide desirable thermal conductivity gradients.

In the illustrated example, the metal foam section 16 is made of a high temperature resistant material that is suitable to withstand the pressures and temperatures associated with operation within an aircraft. For example, the metal foam section 16 is made of nickel, titanium, nickel-based alloy, or mixtures thereof. These materials provide the advantage of relatively high strength, high temperature resistance, oxidation resistance, and chemical resistance to high temperature aircraft fluids. For some lower temperature applications, aluminum may also be used for the metal foam section 16.

In another example, a first type of material is used for the proximal section 36 and a second, different type of material is used for the distal section 38. For example, a material having a relatively high thermal conductivity is used for the proximal section 36 and a material having a relatively lower thermal conductivity is used for the distal section 38 to achieve the nominal thermal conductivity gradient 18. In this example, the pore densities within the proximal section 36 and the distal section 38 may be similar or may be different to further enhance the nominal thermal conductivity gradient 18 as desired. As will be described in the examples below, the principles explained for the previous examples (e.g., nominal thermal conductivity gradient 18, effective density gradient, uniform effective density, porosity, etc.) are applicable in a variety of different configurations.

Figure 4:
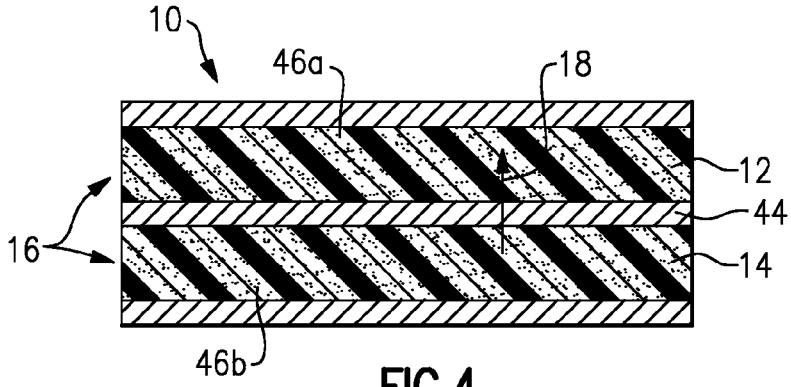
FIG. 4 illustrates a sandwich construction heat exchanger embodiment having metal foam sections separated by a wall.

For example, as seen in the embodiment shown in FIG. 4, the heat exchanger 10 is a sandwich-style construction rather than the tubular construction shown in FIGS. 1 and 2. In this example, the first passage 12 extends adjacently the second passage 14, with a wall 44 separating them. The metal foam section 16 includes a first metal foam section 46*a* within the first passage 12, and a second metal foam section 46*b* within the second passage 14. As explained for the examples above, the metal foam sections 46*a* and 46*b* may have differing effective densities, have differing porosities, be made of different materials, or combinations thereof, to provide a desired thermal conductivity gradient 18 between the first passage 12 and the second passage 14.

Figure 5:
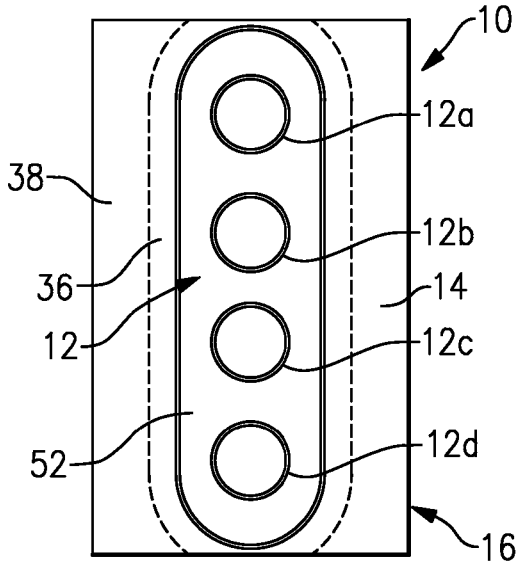
FIG. 5 illustrates a heat exchanger embodiment having microchannels embedded in a metal foam section.

FIG. 5 illustrates another example embodiment wherein the first passage 12 includes multiple microchannels 12*a*, 12*b*, 12*c*, and 12*d* that extend within a unitary solid metal matrix 52. The metal foam section 16, as described in the examples above, surrounds the unitary solid metal matrix 52. In one example, the microchannels 12*a*, 12*b*, 12*c*, and 12*d* are formed using an extrusion process. In another example, the unitary solid metal matrix 52 is made of nickel, titanium, nickel-based alloy, aluminum, or mixtures thereof. As described above, in certain applications, such as aerospace, it may be desirable to utilize one of the high strength, high temperature materials for the metal foam section 16 and the unitary solid metal matrix 52.

Figure 6:
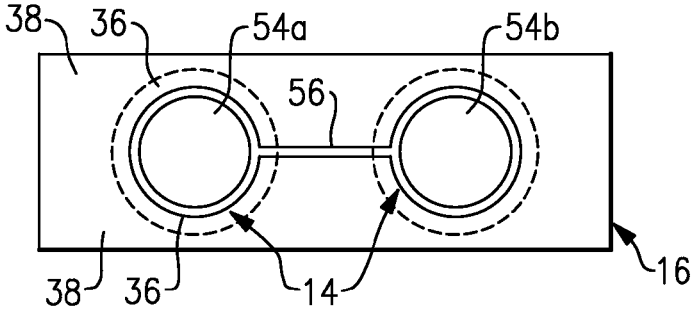
FIG. 6 illustrates a heat exchanger embodiment having a slat fin embedded within a metal foam section.

In another example embodiment shown in FIG. 6, the first passage 14 includes passages 54*a* and 54*b* that are spaced apart from each other. Each of the passages 54*a* and 54*b* is embedded within the metal foam section 16 as described in the examples above. However, in this example, a slat fin 56, extends within the metal foam section 16, between the passages 54*a* and 54*b*. The slat fin 56 in combination with the metal foam section 16, provides heat-conducting surface area and mixing for heat exchange between the passages 54*a*, 54B and the second passage 14.

Figure 7:
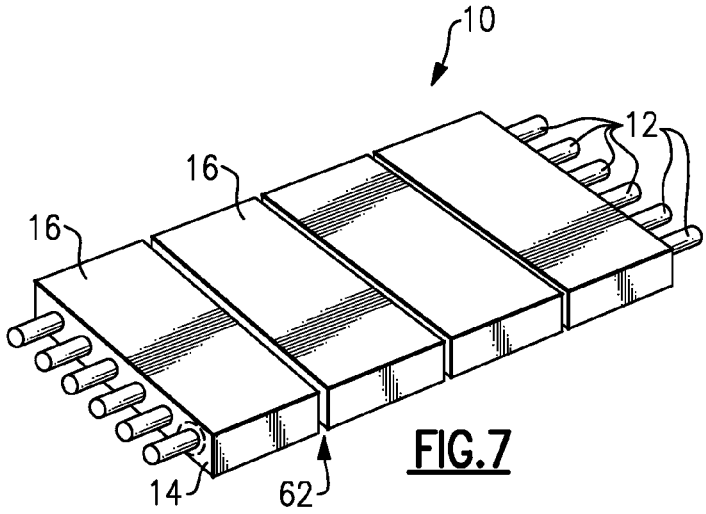
FIG. 7 illustrates a heat exchanger embodiment having multiple metal foam sections that are spaced apart.

FIG. 7 illustrates selected portions of another example heat exchanger 10 embodiment. In this example, several metal foam sections 16 are shown that embed multiple first passages 12 along the length of the first passages 12. In this example, each of the metal foam sections 16 is spaced apart from another metal foam section 16 such that a gap 62 exists there between. The gap 62 permits thermal expansion and contraction between the metal foam sections 16. This provides a benefit of reducing or eliminating thermally induced stresses between the metal foam sections 16.

Figure 8:
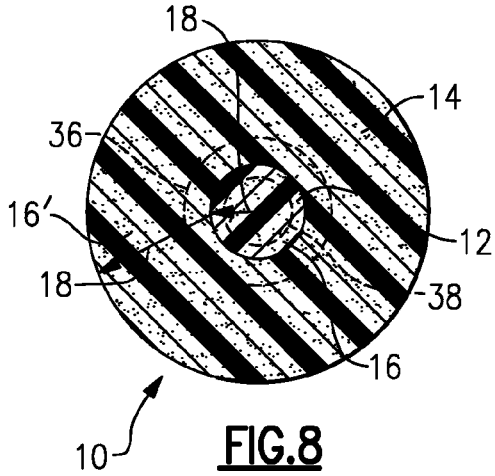
FIG. 8 illustrates a heat exchanger embodiment having a metal foam section within a first passage that is within a second passage.

FIG. 8 illustrates another example embodiment of the heat exchanger 10, wherein the metal foam section 16 is disposed within the first passage 12 instead of the second passage 14. As explained for the above examples, the metal foam section 16 provides a heat-conducting surface and mixing for promoting heat exchange. Optionally, a second metal foam section 16' may be disposed within the second passage 14. In a further example, the metal foam section 16 and the second metal foam section 16' each include a nominal thermal conductivity gradient 18 as described above.

Figure 9A:
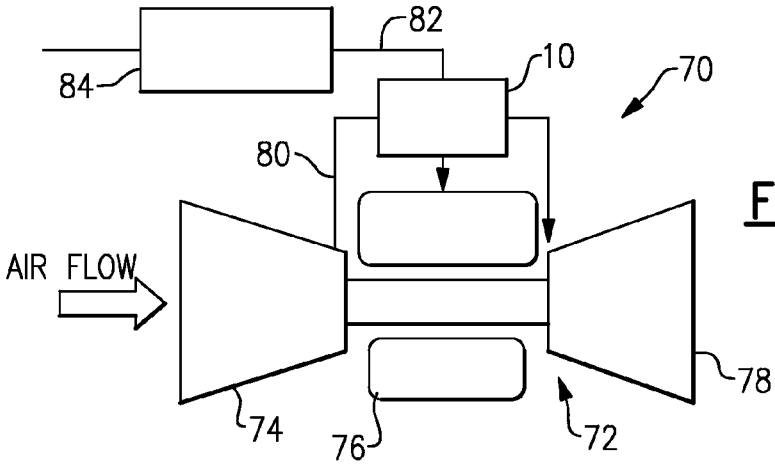
FIG. 9A illustrates a metal foam heat exchanger arranged within a turbine air cooling system.
Figure 9B:
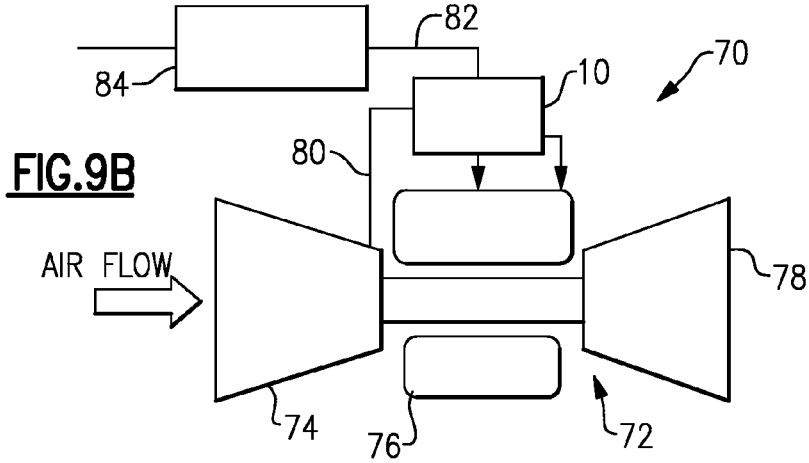
FIG. 9B illustrates another example metal foam heat exchanger arranged within a turbine air cooling system.

The examples above illustrate a few example constructions of the heat exchanger 10. FIG. 9A illustrates an example application of such heat exchangers 10, a turbine cooling system 70 for use in an aircraft. In this example, the turbine cooling system 70 includes one or more of the heat exchanger 10 examples previously described in arrangement with a gas turbine engine 72. The gas turbine engine 72 includes a compressor 74, a combustor 76, and a turbine 78 that operate in a known manner to propel an aircraft. In the illustrated example, the heat exchanger 10 is disposed within a cooling line 80 between the compressor 74 and the turbine 78. Compressed, high temperature air bleeds from the compressor 74 through the cooling line 80 into the heat exchanger 10. In this example, the heat exchanger 10 also receives fuel through fuel line 82 to cool the compressed air received from the compressor 74. The cooled air is then fed into the turbine 78 as, for example, a film of cooled air over the surfaces of the turbine 78 to allow higher combustion exhaust temperatures. The heated fuel continues on from the heat exchanger 10 into the combustor 78. FIG. 9B illustrates another example application of a heat exchanger 10, which is similar to the example shown in FIG. 9A. In this example, the cooled, compressed air is fed into the combustor 76 instead of the turbine 78 as in the previous example.

Optionally, the turbine cooling system 70 includes an upstream unit 84 that suppresses coking in the fuel and enables the fuel to function as a heat sink. For example, the upstream unit 84 includes a fuel deoxygenator unit, protective coatings on surfaces of the upstream unit 84 to prevent adherence of coking products, special fuel compositions that inhibit oxidation of the fuel, or combinations thereof.

Figure 10:
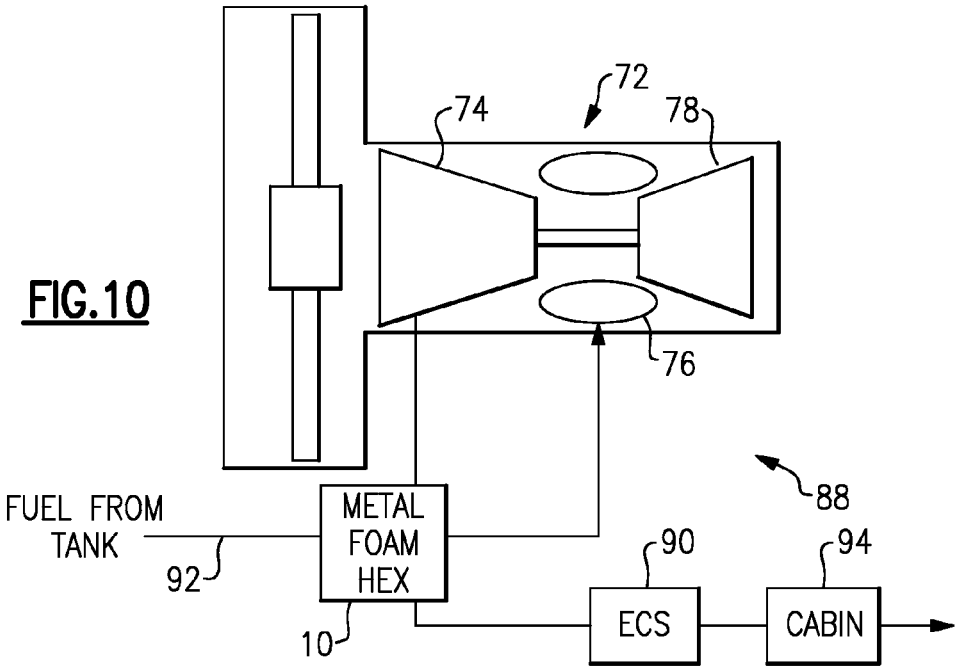
FIG. 10 illustrates a metal foam heat exchanger arranged within an environmental control system for an aircraft.

FIG. 10 illustrates an example embodiment of an aircraft environmental control arrangement 88 wherein one or more of the heat exchangers 10 from the previous examples is in arrangement with an environmental control system 90 of an aircraft. In the illustrated example, the heat exchanger 10 receives relatively hot, compressed air from the compressor 74 and receives fuel through a fuel line 92 to cool the compressed air. The cooled air is discharged to the environmental control system 90, which conditions the cooled air before providing conditioned air to a passenger cabin 94 of an aircraft.

Figure 11:
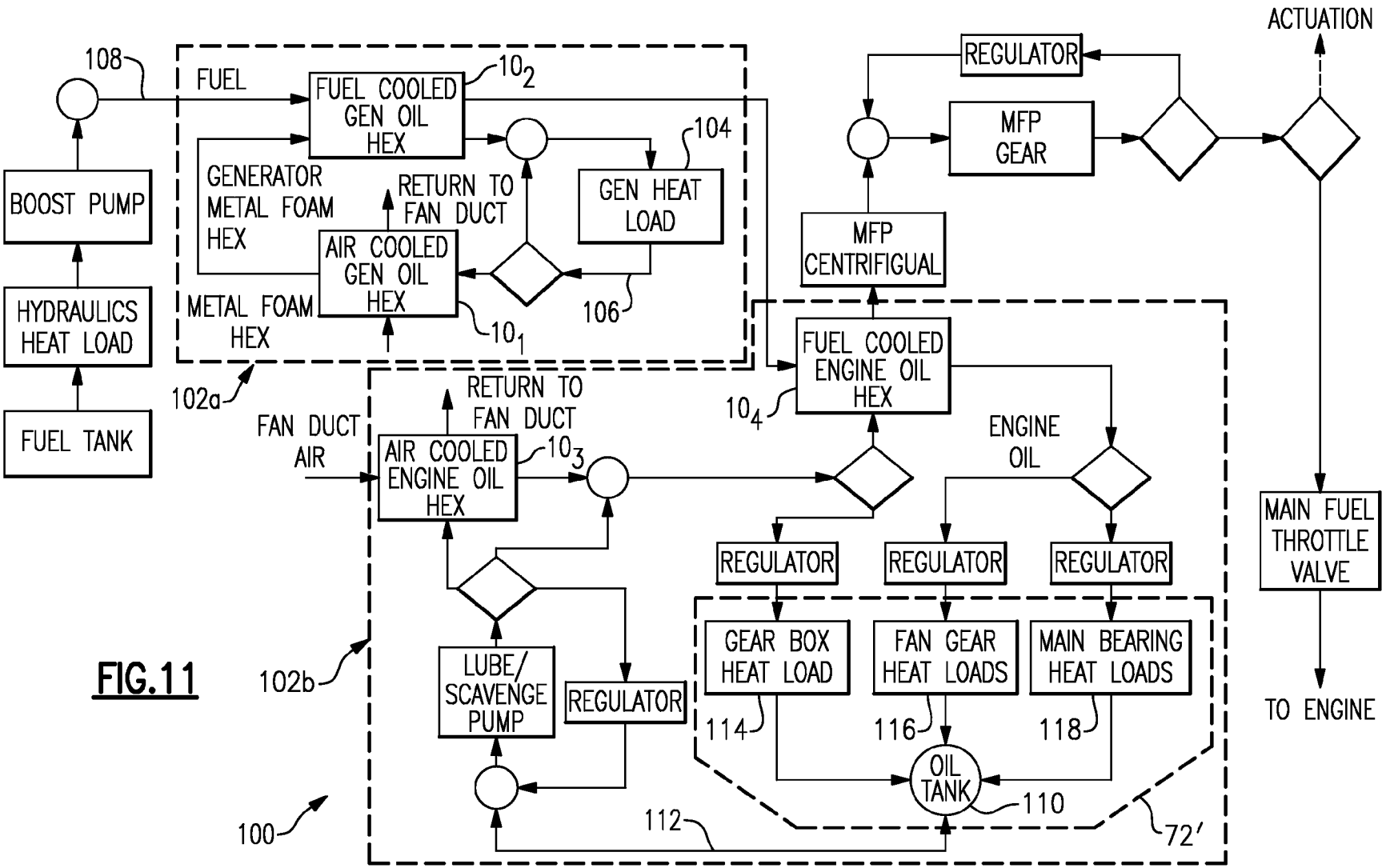
FIG. 11 illustrates metal foam heat exchangers arranged within an aircraft thermal management system.

FIG. 11 illustrates an example embodiment of a thermal management system 100. In this example, the thermal management system 100 includes several cooling loops 102*a* and 102*b* that utilize one or more heat exchangers 10 as described in the examples above. Cooling loop 102*a* includes a heat-generating load 104 that utilizes oil that circulates through oil circulation line 106. The oil is cooled in a first heat exchanger $\mathbf{10}_1$ and subsequently further cooled in a second heat exchanger $\mathbf{10}_2$. In this example, the heat exchanger $\mathbf{10}_1$ is an air-to-liquid heat exchanger and the second heat exchanger $\mathbf{10}_2$ is a liquid-to-liquid heat exchanger. The first heat exchanger 10 receives air from, for example, a ram air source to cool the oil. The second heat exchanger $\mathbf{10}_2$ receives fuel through fuel line 108 to cool the oil within the oil circulation line 106. The combination of the heat exchangers $\mathbf{10}_1$ and $\mathbf{10}_2$ provides progressive cooling of the oil within the oil circulation line 106. This provides the advantage of reducing the burden on any one heat exchanger 10 within the cooling loop 102*a*.

The second cooling loop 102*b* includes an oil tank 110 associated with an aircraft gas turbine engine 72'. Oil from the oil tank 110 circulates through an oil circulation line 112 through a third heat exchanger $\mathbf{10}_3$ and fourth heat exchanger $\mathbf{10}_4$, which provide progressive cooling of the oil. In the illustrated example, the third heat exchanger $\mathbf{10}_3$ is an air-to-liquid heat exchanger and the fourth heat exchanger $\mathbf{10}_4$ is a liquid-to-liquid heat exchanger similar to heat exchangers $\mathbf{10}_1$ and $\mathbf{10}_2$, respectively. The oil circulates from the oil tank 110 through the heat exchangers $\mathbf{10}_3$ and $\mathbf{10}_4$ and is used for lubricating a gear box 114, fan gear 116, or gas turbine engine main bearing 118 of the gas turbine engine 72'.

As can be appreciated, the heat loads and pressures produced within either of the cooling loops 102*a* and 102*a* can be relatively high compared to non-aerospace applications. Thus, in some cases, it may be desirable to utilize the previously mentioned high temperature materials to withstand the temperatures and pressures associated with the circulation lines 106 and 112.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A heat exchanger comprising:

at least one passage; and at least one metal foam section adjacent the passage to promote an exchange of heat relative to the at least one passage, the metal foam section includes a nominal thermal conductivity gradient there through which changes non-linearly as a function of distance from the at least one passage, and the at least one metal foam section includes a proximal portion and a distal portion relative to the at least one passage, the proximal portion having a first nominal thermal conductivity and the distal portion having a second nominal thermal conductivity that is less than the first nominal thermal conductivity to achieve the nominal thermal conductivity gradient.

2. The heat exchanger as recited in claim 1, wherein the proximal portion includes a first porosity and the distal portion includes a second porosity that is greater than the first porosity.

3. The heat exchanger as recited in claim 1, wherein the at least one metal foam section comprises nickel, titanium, nickel-based alloy, or mixtures thereof.

4. The heat exchanger as recited in claim 1, wherein the at least one metal foam section comprises aluminum.

5. The heat exchanger as recited in claim 1, wherein the at least one metal foam section includes a first section that circumscribes the at least one passage and a second section within the passage.

6. The heat exchanger as recited in claim 5, wherein the first section has a first nominal thermal conductivity gradient there through and the second section has a second nominal thermal conductivity gradient there through.

7. A heat exchanger comprising:

at least one passage; and at least one metal foam section adjacent the passage to promote an exchange of heat relative to the at least one passage, the at least one metal foam section including a nominal thermal conductivity gradient there through and having a proximal portion and a distal portion relative to the at least one passage, the proximal portion having a first nominal thermal conductivity and the distal portion having a second nominal thermal conductivity that is less than the first nominal thermal conductivity to achieve the nominal thermal conductivity gradient, wherein the proximal portion comprises a first material and the distal portion comprises a different, second material.

8. The heat exchanger as recited in claim 7, wherein the proximal portion is in direct contact with the at least one passage and the distal portion.

9. The heat exchanger as recited in claim 7, wherein the at least one metal foam section comprises a gradual change in nominal thermal conductivity between the proximal portion and the distal portion.

10. The heat exchanger as recited in claim 7, wherein the proximal portion includes a first effective density and the distal portion includes a second effective density that is less than the first effective density.

11. The heat exchanger as recited in claim 7, wherein the at least one passage defines a flow direction there through, and the at least one metal foam section completely circumferentially surrounds the at least one passage relative to the flow direction.

12. A heat exchanger system for use in an aircraft, comprising:

an aircraft device operative to circulate a fluid; and at least one heat exchanger having a passage for receiving the fluid and a metal foam section adjacent the passage to promote an exchange of thermal energy with the fluid, and the metal foam section includes a proximal portion and a distal portion relative to the passage, the proximal portion having a first nominal thermal conductivity and the distal portion having a second nominal thermal conductivity that is less than the first nominal thermal conductivity to achieve a nominal thermal conductivity gradient which changes non-linearly as a function of distance from the passage.

13. The system as recited in claim 12, wherein the aircraft device comprises a gas turbine engine compressor and the fluid comprises compressed air.

14. The system as recited in claim 13, further comprising a gas turbine engine combustor for receiving cooled compressed air from the at least one heat exchanger.

15. The system as recited in claim 13, further comprising an environmental control system for receiving cooled compressed air from the heat exchanger and providing conditioned air to a passenger cabin.

16. The system as recited in claim 13, further comprising a turbine for receiving cooled compressed air from the heat exchanger to cool the turbine.

17. The system as recited in claim 13, further comprising a fuel storage that is fluidly connected to the at least one heat exchanger such that the metal foam heat exchanger transfers the thermal energy from the fluid to the fuel.

18. The system as recited in claim 12, wherein the aircraft device comprises at least one of an engine gear box, an engine fan gear, or an engine main bearing.

19. The system as recited in claim 12, wherein the at least one heat exchanger comprises a liquid-to-liquid heat exchanger and an air-to-liquid heat exchanger for cooling the fluid.

* * * * *